United States Patent [19]

Hoerner

[11] Patent Number: 4,979,547

[45] **Date of Patent: * Dec. 25, 1990**

[54] TRASH BAG SUPPORT SLEEVE

[76] Inventor: L. Jeanne Hoerner, P.O. Box 2669, Visalia, Calif. 93279

[ * ] Notice: The portion of the term of this patent subsequent to Jan. 2, 2007 has been disclaimed.

[21] Appl. No.: 440,089

[22] Filed: Nov. 22, 1989

Related U.S. Application Data

[63] Continuation-in-part of Ser. No. 29,616, Mar. 23, 1987, Pat. No. 4,890,652.

[51] Int. Cl.[5] ..... B65B 39/02; B65B 67/00; B65B 5/12

[52] U.S. Cl. ..... 141/390; 141/10; 141/114; 141/314; 141/98; 15/257.1; 248/95; 229/117; 383/119; 53/390

[58] Field of Search ..... 141/10, 114, 313-390, 141/391, 392, 98; 248/97-101, 95; 15/257.1; 53/390; 220/403, 404; 383/119; 229/3.1, 117, 117.01

[56] References Cited

U.S. PATENT DOCUMENTS

| | | | |
|---|---|---|---|
| 576,782 | 2/1897 | Goodrich | 141/390 |
| 672,657 | 4/1901 | Vautrot | 141/390 |
| 1,139,281 | 5/1915 | Hazelton | 383/119 |
| 2,216,299 | 10/1940 | Schilling | 229/132 X |
| 2,676,750 | 4/1954 | Gastright | 229/117 |
| 3,172,593 | 3/1965 | Potter | 229/3.1 X |
| 3,404,988 | 10/1968 | Rausing | 229/3.1 X |
| 3,443,739 | 5/1969 | Adams, Jr. | 229/117 |
| 3,822,524 | 7/1974 | Jerpbak | 53/390 X |
| 3,915,329 | 10/1975 | Zaks | 141/390 X |
| 3,960,313 | 6/1976 | Sax et al. | 229/117 X |
| 3,965,087 | 2/1976 | Alexander | 248/99 X |
| 3,976,527 | 8/1976 | Thompson et al. | 229/3.1 X |
| 3,983,914 | 10/1976 | Benson | 141/390 |
| 4,037,778 | 7/1977 | Boyle | 141/390 |
| 4,115,909 | 9/1978 | Corella | 141/390 X |
| 4,126,266 | 11/1978 | Roccaforte | 229/117 X |
| 4,268,081 | 5/1981 | Hawkinson | 15/257.1 X |
| 4,338,979 | 7/1982 | Dow | 141/10 |
| 4,457,483 | 7/1984 | Gagné | 248/97 |
| 4,509,570 | 4/1985 | Eby et al. | 141/390 |
| 4,530,533 | 7/1985 | Dieter | 141/390 X |
| 4,601,407 | 7/1986 | Gillard | 229/117.01 X |
| 4,620,681 | 11/1986 | Staley, III et al. | 248/95 |
| 4,622,693 | 11/1986 | Mykleby | 383/119 |
| 4,628,007 | 12/1986 | Ledsham | 141/390 X |
| 4,749,011 | 6/1988 | Rylander | 141/316 |
| 4,760,982 | 8/1988 | Cooke | 248/99 |
| 4,884,603 | 12/1989 | Simpson | 141/390 |
| 4,890,652 | 1/1990 | Hoerner | 141/10 |

FOREIGN PATENT DOCUMENTS

| | | | |
|---|---|---|---|
| 2641632 | 3/1978 | Fed. Rep. of Germany | 229/3.1 |

OTHER PUBLICATIONS

PKG 320, "Packaging Materials", required reading School of Packaging Summer 1977.

*Primary Examiner*—Ernest G. Cusick

*Attorney, Agent, or Firm*—Baker, Maxham, Jester & Meador

[57] ABSTRACT

An elongated sleeve made of a plurality of substantially rigid panels interconnected with one another in folding relationship. When in the stored condition, the sleeve is folded flat. When in condition to be used for its intended purpose, the sleeve is unfolded to form an open ended sleeve closed on the sides. The sleeve is adapted to positively retain and support a collapsible bag at the top while the bag is being filled by filling the interior of the sleeve. Handles are provided in the top edges of the sleeve to facilitate removal of the sleeve from the full bag. The panels are internally laminated with a water repellant adhesive while the inside of the sleeve is coated with a moisture resistant compound.

11 Claims, 2 Drawing Sheets

FIG. 1
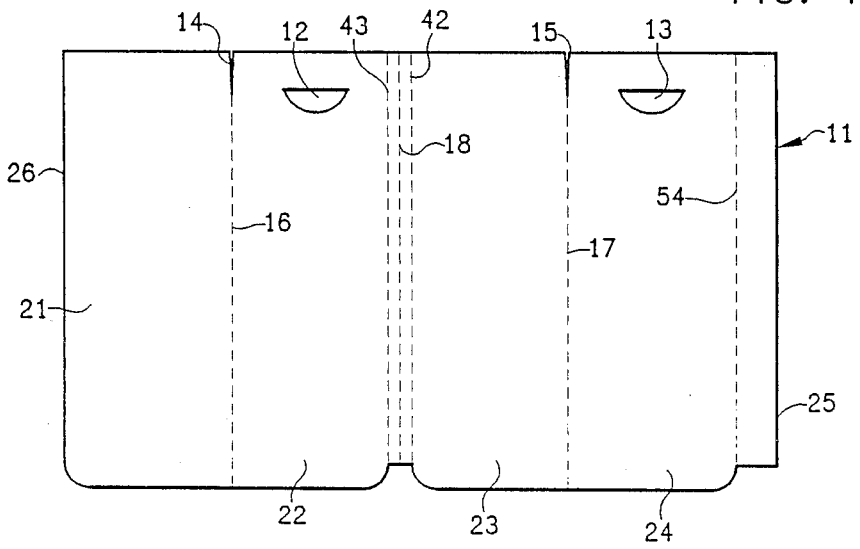
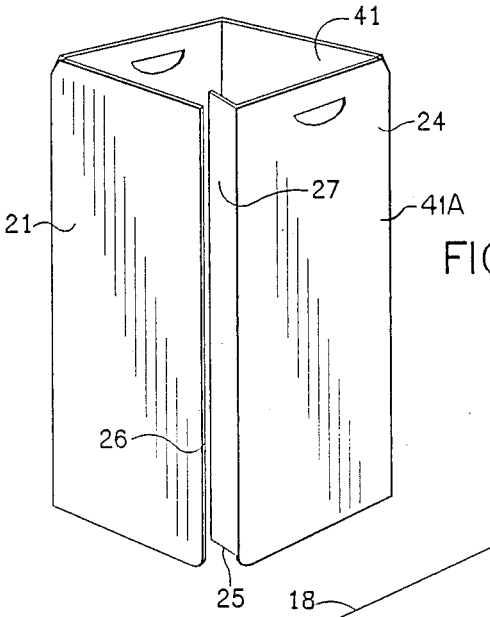
FIG. 2
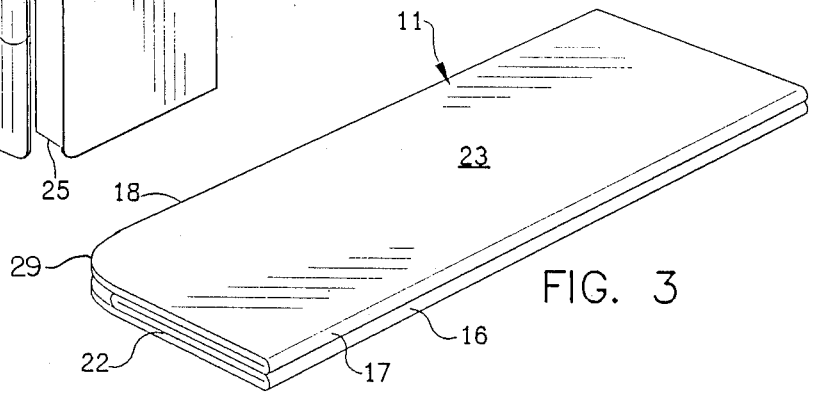
FIG. 3

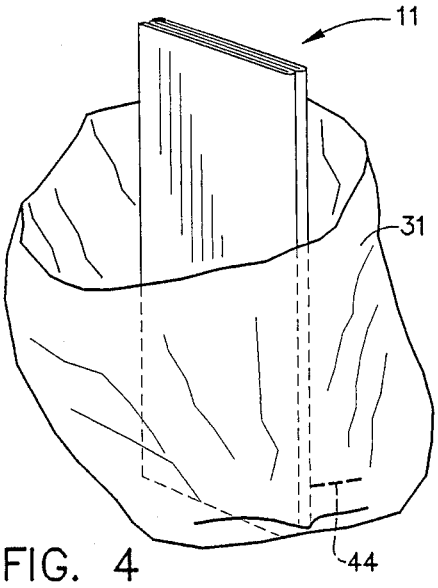
FIG. 4
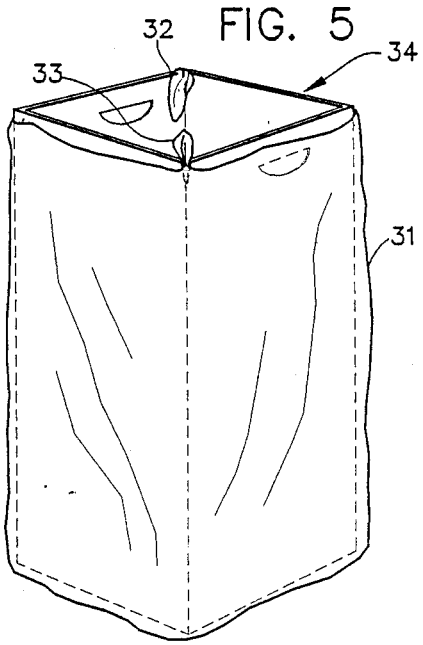
FIG. 5
FIG. 6
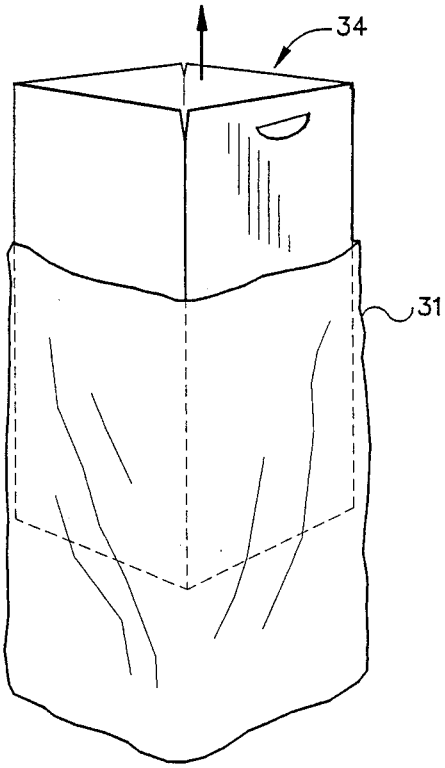
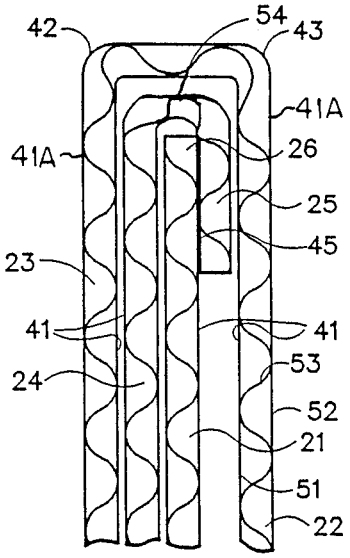
FIG. 7

TRASH BAG SUPPORT SLEEVE

CROSS REFERENCE TO RELATED APPLICATION

This is a continuation-in-part of application Ser. No. 07/029,616, filed Mar. 23, 1987, now U.S. Pat. No. 4,890,652, issued Jan. 2, 1990.

FIELD OF THE INVENTION

This invention relates generally to devices for supporting trash bags during the filling process, and more particularly concerns a smooth-sided relatively rigid sleeve made of a plurality of side panel members adapted to reside within the bag during the filling process and to be easily removed therefrom when the bag is full.

BACKGROUND OF THE INVENTION

Filling plastic bags with debris, while a simple process, is often quite vexing in that the bag tends to collapse and the open upper end very often folds in upon itself just at the moment when something bulky needs to be inserted. Another problem is that when relatively multi-faceted, elongated or angular items such as portions of rose bushes or tree branches are inserted, it is very easy to tear the bag.

This problem has been recognized in the past and several attempts have been made to rectify it. U.S. Pat. No. 4,037,778 shows a plurality of elongated rigid panels some of which are interconnected in a folding relationship, where the open sided structure that is formed tends to open outwardly to frictionally hold the sides of the plastic bag to prevent the bag from collapsing. When the bag is full, the liner is removed from inside the bag. U.S. Pat. No. 4,628,007 shows a circular insert having a similar purpose and functioning in a similar way, that is, it is not a closed structure and it frictionally engages the side walls of the bag by opening outwardly against them. Another circular insert, which also is intended to be used externally, is shown in U.S. Pat. No. 4,457,483. This patent also discloses spring loaded tab/-cutouts which are intended to retain a small portion of bag material to hold the bag and sleeve upright together. Narrow collar-type bag holders are shown in U.S. Pat. No. 4,530,533 and 4,620,681.

Generally, the prior art devices do not have closed sides nor a means for positively holding the top open edge of the bag in appropriate relationship with the top of the sleeve. More importantly, they do not protect the entire length of the bag while being filled and they do not fold flat, one panel in width, for storage and shipment.

SUMMARY OF THE INVENTION

The structure of the present invention provides means for maintaining a collapsible bag in fully open condition and for positively retaining the top open edges of the bag during the filling process. Those edges are easily released from the top of the sleeve and the sleeve easily removed from the bag after it has been filled.

The sleeve of this invention is comprised of several interconnected panels which are adapted to fold upon each other to form a flat, rectangular structure, one panel in width, in the stored condition. All of the panels are interconnected to form an enclosed sleeve when it is opened to its operative condition whereby just the ends are opened allowing trash to be put into one end and come out through the other end when the sleeve is lifted out of the bag. The sleeve has the additional feature of water repellant adhesive employed for laminating and assembling the panels, and a water resistant coating on the inside or the outside, or both, of the sleeve.

The positive bag retaining aspect comprises one or more narrow slits at the corners of the sleeve, each of which positively retains a small portion of the bag material. Any force that would tend to pull the bag downwardly would serve to further enhance the firmness with which the bag is held in those slots. Additionally, hand holes are provided to facilitate lifting the sleeve out of the bag after the filling process is complete.

BRIEF DESCRIPTION OF THE DRAWING

The objects advantages and features of this invention will be more readily perceived from the following detailed description when read in conjunction with the accompanying drawing, in which:

FIG. 1 shows in plan view the interconnected panel blank of this invention in the open, flat, non-joined condition;

FIG. 2 is a perspective view depicting the blank of FIG. 1 ready for final assembly by joining the opposite long edges;

FIG. 3 is a perspective view of the sleeve of the invention in the flat condition for storing and shipping;

FIG. 4 is a perspective view of the invention of FIG. 3 placed in a collapsible bag ready for opening to form the sleeve structure;

FIG. 5 is a perspective view showing the sleeve of the invention in operative condition within a collapsible bag with the top edges of the bag secured to the sleeve slits;

FIG. 6 is a perspective view depicting the sleeve of the invention being removed from the collapsible bag after the bag has been filled; and FIG. 7 shows an enlarged detail of the joining corner structure of the sleeve.

DETAILED DESCRIPTION OF THE PREFERRED EMBODIMENT

As shown in FIG. 1, the sleeve of the invention may be comprised of a rectangular blank 11 formed of substantially rigid material which is lightweight and of appropriate thickness. The material from which this blank is made is contemplated to be a cardboard or pasteboard but it could be made of any material which satisfies the stated requirements. A preferred material for the blank is balanced kraftboard (200#) which has characteristics to resist warping. The sleeve may be reusable or disposable and its surfaces may be untreated or it may be coated with wax, plastic or other substance, such as a water resistant compound sold under the trademark Michelman, identified in FIGS. 2 and 7 by the reference numeral 41, on the inside surfaces and 41A on the outside surfaces to make it waterproof, longer lasting or more slippery, for example. Further, the blank may be made in a variety of sizes to fit various sizes of collapsible trash bags. Typically, these bags are thought of as plastic bags and that term will be used herein in the generic sense. When made of a laminated structure such as pasteboard, a water resistant adhesive is employed to secure the laminations together to afford long life to the sleeve when the sleeve is subject to moisture. Such a water repellant adhesive is sold under the trademark WRA.

The blank is formed with hand-hold cut-outs 12 and 13 which would typically be cut on the arc and folded inwardly along the straight line. This would protect the user's hands when lifting the sleeve out of the filled bag. Slits 14 and 15 are formed at the ends of two creases 16 and 17 between adjacent panels at that location. The slits are relatively narrow and may have parallel sides or be wedge shaped to readily receive a portion of the plastic bag. Preferably slits 14 and 15 are two to three inches long, or approximately 10–15% of the length of the panels. The slits are shown at the ends of the connection lines or creases, but they could be at any place along the edge of the sleeve.

Panel 21 is at one end of the rectangular blank, panels 22 and 23 are the middle panels, panel 24 is at the opposite end, and a narrow tab 25 extends from the outside long edge of panel 24.

As shown in FIG. 2, when the panels are folded at creases 16, 17 and 18, with tab 25 adjacent and under the free edge 26 of panel 21, a closed rectangle is formed. Adhesive may be applied to what may be termed the outside surface 27 of tab 25 and the tab is folded inside free edge 26 of panel 21 and secured thereto, thereby forming the closed rectangular sleeve. Alternatively, the tab may be secured to panel 21 by other means such as stapling or riveting, among others.

Note that the sleeve in its final form for use has a square cross section. This configuration facilitates folding the sleeve to a flat condition, one panel wide for packaging and storage.

At least one fold line, such as fold line 18 between panels 22 and 23, must be sufficiently wide to permit the double wide folding required for the flat, stored condition shown in FIGS. 3 and 7. This double wide fold requires double scoring, represented by dotted lines 42 and 43 in FIG. 1. Some of the panels fold closely on each other while panels 22 and 23 as shown in FIG. 3 must have the wider fold line so that the panels can lie flat. All four panels are in parallel, confronting relationship. Rounded corners 29 are provided for protection of the bag on insertion of the sleeve into the bag in the folded condition. It is contemplated that the product in the flat condition shown in FIG. 3 for storage and transportation would be packaged by shrink wrapping or a stretch wrapping in accordance with current known methods, with appropriate labeling on the product and possibly on the packaging itself.

When ready for use, the wrapping is removed and the product, still in the flattened condition, is inserted into plastic bag 31 as shown in FIG. 4. To facilitate opening of the sleeve to its operative condition, the folded sleeve is inserted so as to be oriented perpendicular to normally straight bottom seam 44 of the bag. The first unfolding step will result in edge folds 16 and 17 fitting into the side folds of the bag, which extend upwardly from the ends of the straight bottom seam. The product is then fully opened up as shown in FIG. 5 to form sleeve 34, occupying substantially the entire interior of the plastic bag. The user then pulls a small portion 32, 33 of the top edge of the bag inward through each of slits 14 and 15, thus positively anchoring the top of the bag to the sleeve and preventing any possible slippage due to gravity. Note that any downward pull on the bag will only serve to more firmly anchor the bag in the slits. If desired, similar slits can be formed in all four corners for even more positive anchoring of the top of the bag.

The user can then fill the bag with whatever items are to be disposed of, such as lawn clippings, shrub cuttings, leaves and other trash. Party waste can also be inserted, with the bag being held in the upright open condition facilitating its use by guests. The waste material can be firmly compressed down into sleeve 34 as it is being filled, thus allowing a substantially larger volume of material to be stored than would otherwise be possible without the use of such a sleeve.

It should now be apparent that the sleeve not only supports the bag in an upright filling condition but guards the sides of the bag against punctures and tears from thorns or other sharp, ragged materials and also guides the filling process by virtue of the rigid support system which it provides.

When the level of material being stored has risen to within a few inches of the top of sleeve 34, the user withdraws bag elements 32 and 33 from the anchoring slits, the user's fingers are inserted between the bag and the outside of the sleeve in hand-hold cut-outs 12 and 13 and with a gentle shaking motion, sleeve 34 is easily removed from the interior of bag 31. The weight of the contents has the gravitational effect of keeping the contents in the bag and keeping the bag on the ground while the lightweight, empty sleeve is being removed. The filled bag is then ready to be tied and disposed of.

Further detail of the joined sides and how they fold together are shown in FIG. 7. Facing surfaces of panels 21, 11 and 23, 24 are coated with moisture resistant material 41. Adhesive material 45 between flap 25 and the confronting surface of panel 21 is a water repellant adhesive, which has characteristics similar to the adhesive which secures together inner sheet 51, outer sheet 52 with corrugated material 53 sandwiched between. Connecting link or connection line 54, the scored portion of material between tab 25 and panel 24, is compressed somewhat to enhance its ability to be a reversible fold. As shown in the flat condition of FIGS. 3 and 7, the confronting surfaces of panels 21 and 24 are the outside surfaces of the sleeve. When the sleeve is opened to its operative, square condition this connection line allows reverse folding to a 90° relationship between adjacent panels 21 and 24, where the surfaces coated with material 41 face as shown in FIG. 2 and the previously confronting surfaces are part of the external surface of the sleeve.

While the sleeve as shown in the drawing comprises a top and a bottom where the top includes the hand-hold cut-outs and the slits, blank 11 of FIG. 1 could easily be formed with the cut-outs and the slits in both opposite edges. Thus there would be no top or bottom, thereby making the sleeve of the invention even easier to use since it need not be oriented with respect to the bag.

In view of the above description, it is likely that modifications and improvements will occur to those skilled in the art which are within the scope of the appended claims. For example, tab 25 could be replaced by other closure means such as hook and loop strips.

What is claimed is:

1. A sleeve for supporting and protecting the inside surface of a collapsible bag during the process of filling the bag, said sleeve comprising:

four similarly shaped, substantially continuously rigid elongated panels connected together to form an elongated area of connection between each adjacent two said panels and to form a unitary closed square cross-sectional structure about an axis and having an open top and an open bottom with respective opposite top and bottom edges, said elongated area of connection between each adjacent two said panels being a connection line, said connection lines being formed by scoring lines, one of said connection lines being formed by spaced double scoring lines to form an enhanced width connection line between two adjacent panels; and at least one top narrow slit formed in said top edge of said structure and extending a relatively short distance toward said bottom edge thereof;

at least one slit being adapted to receive a portion of the material at the open end of the bag in a secure wedging relationship to thereby positively retain the bag in upright supported condition around said structure;

said square structure adapted for being generally the same length from said top edge to said bottom edge as the length of the bag, thereby providing coextensive, full length protection of the inside bag wall from damage when material is forced into it, and positively self supporting the bag in an upright condition;

said panels being mutually foldable at each said connection line between each two adjacent panels so that said structure may be folded to a flat condition, one panel in width for storage and shipping, said one enhanced width connection line facilitating the folding of said panels to a flat condition.

2. The sleeve recited in claim 1, wherein the connection line opposite to said enhanced width connection line forms a reversible fold which is folded one way upon itself when said structure is in the flat condition and is folded in the opposite direction when said structure is in the closed square cross-sectional condition.

3. A sleeve for supporting and protecting the inside surface of a collapsible bag during the process of filling the bag, said sleeve comprising:

four similarly shaped, substantially continuously rigid elongated panels connected together to form an elongated area of connection between each adjacent two said panels and to form a unitary closed square cross-sectional structure about an axis and having an open top and an open bottom with respective opposite top and bottom edges and having an inside surface and an outside surface, said elongated area of connection between each adjacent two said panels being a connection line;

at least one top narrow slit formed in said top edge of said structure and extending a relatively short distance toward said bottom edge thereof; and a moisture resistant coating on at least one of said inside and outside surfaces of said sleeve;

said slit being adapted to receive a portion of the material at the open end of the bag in a secure wedging relationship to thereby positively retain the bag in upright supported condition around said structure;

said square structure adapted for being generally the same length from said top edge to said bottom edge as the length of the bag, thereby providing coextensive, full length protection of the inside bag wall from damage when material is forced into it, and positively self supporting the bag in an upright condition;

said panels being mutually foldable at each said connection line between eah two adjacent panels so that said structure may be folded to a flat condition, one panel in width, for storage and shipping.

4. The sleeve recited in claim 3, wherein said moisture resistant coating is on said inside surface of said sleeve.

5. The sleeve recited in claim 3, wherein said moisture resistant coating is on said outside surface of said sleeve.

6. The sleeve recited in claim 3, wherein said moisture resistant coating is on said inside and said outside surfaces of said sleeve.

7. A sleeve for supporting and protecting the inside surface of a collapsible bag during the process of filling the bag, said sleeve comprising:

four similarly shaped, substantially continuously rigid elongated panels formed from a unitary blank of balanced kraftboard having opposite end edges and opposite side edges, score lines from one side edge of said blank to the opposite side edge defining said panels and an elongated connection line between each adjacent two said panels to form a unitary closed square cross-sectional structure about an axis and having an open top and an open bottom with respective opposite top and bottom edges; and at least one top narrow slit formed in said top edge of said structure and extending a relatively short distance toward said bottom edge thereof;

said at least one slit being adapted to receive a portion of the material at the open end of the bag in a secure wedging relationship to thereby positively retain the bag in upright supported condition around said structure;

said square structure adapted for being generally the same length from said top edge to said bottom edge as the length of the bag, thereby providing coextensive, full length protection of the inside bag wall from damage when material is forced into it, and positively self supporting the bag in an upright condition;

said panels being mutually foldable at each said connection line between each two adjacent panels so that said structure may be folded to a flat condition, one panel in width, for storage and shipping.

8. The sleeve recited in claim 7, wherein said panels are formed of 200# weight kraftboard.

9. The sleeve recited in claim 7, wherein said kraftboard is a laminated structure secured together by a water repellant adhesive.

10. The sleeve recited in claim 7, wherein said blank is formed with a narrow tab along said one end edge, said tab being secured to said end edge on the opposite side of said blank by means of a water repellant adhesive.

11. A sleeve for supporting and protecting the inside surface of a collapsible bag during the process of filling the bag, said sleeve comprising:

four similarly shaped, substantially continuously rigid elongated panels connected together to form an elongated area of connection between each adjacent two said panels and to form a unitary closed square cross-sectional structure about an axis and having an open top and an open bottom with respective opposite top and bottom edges, said elongated area of connection between each adjacent two said panels being a connection line; and at least one top narrow slit formed in said top edge of said structure and extending a relatively short distance toward said bottom edge thereof;

said at least one slit being adapted to receive a portion of the material at the open end of the bag in a secure wedging relationship to thereby positively retain the bag in upright supported condition around said structure;

said square structure adapted for being generally the same length from said top edge to said bottom edge as the length of the bag, thereby providing coextensive, full length protection of the inside bag wall from damage when material is forced into it, and positively self supporting the bag in an upright condition;

said panels being mutually foldable at each said connection line between each two adjacent panels so that said structure may be folded to a flat condition, one panel in width, for storage and shipping, the bottom corners of said flat folded configuration of said sleeve being rounded for protection of the bag on insertion into the bag in the folded condition.

* * * * *